US009050626B2

(12) United States Patent
Muller

(10) Patent No.: US 9,050,626 B2
(45) Date of Patent: Jun. 9, 2015

(54) METHOD OF FABRICATING A PART DECORATED WITH RELIEF

(75) Inventor: Juliette Muller, La Neuveville (CH)

(73) Assignee: ETA SA Manufacture Horlogere Suisse, Grenchen (CH)

( * ) Notice: Subject to any disclaimer, the term of this patent is extended or adjusted under 35 U.S.C. 154(b) by 137 days.

(21) Appl. No.: 13/378,833

(22) PCT Filed: Jun. 25, 2010

(86) PCT No.: PCT/EP2010/059085

§ 371 (c)(1),
(2), (4) Date: Dec. 16, 2011

(87) PCT Pub. No.: WO2011/003756

PCT Pub. Date: Jan. 13, 2011

(65) Prior Publication Data

US 2012/0100305 A1 Apr. 26, 2012

(30) Foreign Application Priority Data

Jul. 6, 2009 (EP) ..... 09164688

(51) Int. Cl.

| | |
|---|---|
| ***B05D 3/00*** | (2006.01) |
| ***B05D 5/00*** | (2006.01) |
| ***B05D 1/32*** | (2006.01) |
| *B44C 1/24* | (2006.01) |
| *B44C 1/22* | (2006.01) |
| *G04B 19/10* | (2006.01) |
| *G04D 3/00* | (2006.01) |

(52) U.S. Cl.

CPC ... *B05D 1/32* (2013.01); *B44C 1/24* (2013.01); *B44C 1/22* (2013.01); *G04B 19/10* (2013.01); *G04D 3/0048* (2013.01)

(58) Field of Classification Search

None

See application file for complete search history.

(56) References Cited

U.S. PATENT DOCUMENTS

| | | | | |
|---|---|---|---|---|
| 2,642,390 | A | 6/1953 | Garofano | |
| 3,054,175 | A | 9/1962 | Spreter | |
| 3,989,603 | A * | 11/1976 | Montavon | 205/121 |
| 6,180,171 | B1 * | 1/2001 | Ota et al. | 427/275 |
| 6,753,068 | B2 * | 6/2004 | Nakamura et al. | 428/172 |
| 2002/0095874 | A1 * | 7/2002 | Tsuchiya et al. | 51/308 |
| 2006/0121271 | A1 * | 6/2006 | Frey et al. | 428/333 |
| 2008/0095985 | A1 * | 4/2008 | Frey et al. | 428/156 |

FOREIGN PATENT DOCUMENTS

| | | |
|---|---|---|
| CH | 344374 | 1/1960 |
| JP | 60 4879 | 1/1985 |

OTHER PUBLICATIONS

International Search Report Issued Sep. 20, 2010 in PCT/EP10/59085 Filed Jun. 25, 2010.

* cited by examiner

*Primary Examiner* — Timothy Meeks
*Assistant Examiner* — Michael P Rodriguez
(74) *Attorney, Agent, or Firm* — Oblon, McClelland, Maier & Neustadt, L.L.P.

(57) ABSTRACT

A method for fabricating a part with relief, wherein portions in relief are at least partially coated with a decorative layer. The method a) forms the body of the part; b) selectively alters the surface state of the body of the part to change the adherence thereof locally relative to the decorative layer; c) directly deposits the decorative layer over the entire body; d) removes the portions of the deposited layer which have not adhered to the body of the part. The method can be utilized in decorating timepieces.

8 Claims, 3 Drawing Sheets

A - A

B - B

METHOD OF FABRICATING A PART DECORATED WITH RELIEF

CROSS-REFERENCE TO PRIORITY APPLICATIONS

This is a National Phase Application in the United States of International Patent Application PCT/EP2010/059085 filed Jun. 25, 2010, which claims priority on European Patent Application No. 09164688.5 of Jul. 6, 2009. The entire disclosures of the above patent applications are hereby incorporated by reference.

FIELD OF THE INVENTION

The invention relates to a method for fabricating a part decorated with relief and, more specifically, a plastic part whose decorations have a metallic appearance.

BACKGROUND OF THE INVENTION

A timepiece dial usually includes appliques for decorating the dial. These appliques may, for example, represent an hour circle to facilitate determination of the time relative to the position of the timepiece hands.

These appliques may also simply be used to give the dial an attractive appearance.

Usually, these appliques are assembled on the dial by a series of bonding, then possibly masking and/or buffing steps, which, in addition to the cost of the appliques, lead to excessive fabrication costs due to the positioning precision required, which increases with the thickness of the applique.

SUMMARY OF THE INVENTION

It is an object of the present invention to overcome all of part of aforecited drawbacks by proposing, more generally, a method for fabricating a decorated part which has fewer steps and uses less material to make the decorations.

The invention therefore relates to a method for fabricating a part with relief, wherein said portions in relief are at least partially coated with a decorative layer, including the following step:

a) forming the body of the part;

characterized in that the method further includes the following steps:

b) selectively modifying the surface state of the body of the part in order to change the adherence thereof locally relative to said decorative layer;

c) directly depositing said decorative layer over the entire body;

d) removing the portions of the deposited layer which have not adhered to the body of the part.

Advantageously according to the invention, it is thus clear that it is no longer necessary to selectively deposit the decorations. The prior structuring operation allows the adhesion and/or non adhesion areas to be precisely selected in order to simplify the step of depositing the decoration(s).

In accordance with other advantageous features of the invention:

Step b) is for locally reducing the adherence of the surface of the body so that, in step c), the deposited layer does not adhere to the altered portions;

The reduction in adherence is obtained by forming bosses alternately with hollows, the height and width of the hollows being respectively comprised between 50 and 200 μm, and 5 and 10 μm, and the width of the bosses between 0.1 and 3 μm;

Step b) is for locally increasing the adherence of the surface of the body so that, in step c), the deposited layer adheres to the altered portions;

The increased adherence is obtained by forming bosses alternately with hollows, the height and the width of the hollows being respectively comprised between 2 and 10 μm and 5 and 20 μm, and the width of the bosses between 5 and 20 μm;

The widths of the hollows and the bosses are substantially equal;

Step a) is achieved by injecting material into a mould;

Steps a) and b) are performed at the same time by locally altering the internal surface state of said mould;

Step b) is performed by laser type radiation;

Step c) is achieved by vapour phase deposition;

The decorative layer includes at least one metallic material;

After step d), galvanoplasty is performed in order to thicken each portion including said decorative layer;

The body of the part is made using a plastic material;

The part with relief is a timepiece dial.

BRIEF DESCRIPTION OF THE DRAWINGS

Other features and advantages will appear clearly from the following description, given by way of non-limiting indication, with reference to the annexed drawings, in which.

DETAILED DESCRIPTION OF PREFERRED EMBODIMENTS

Figure 1:
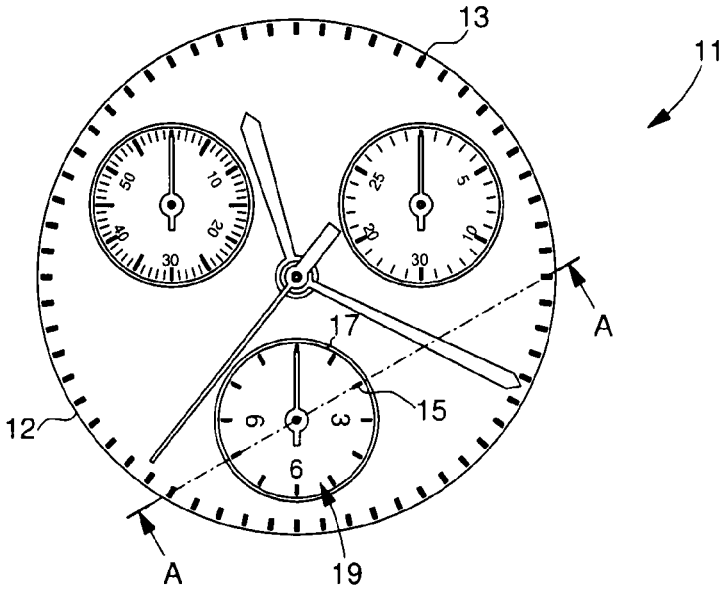
FIG. 1 is a typical timepiece dial seen from above.
Figure 2:
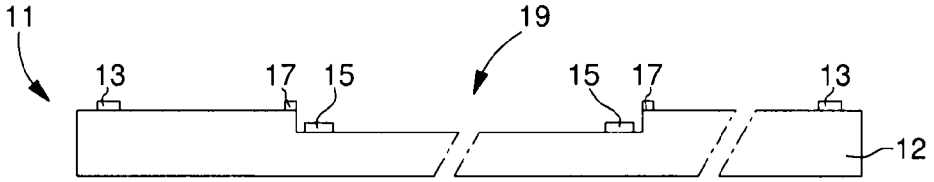
FIG. 2 is a schematic cross-section along line A-A of FIG. 1.

FIGS. 1 and 2 show a typical dial 11 for a timepiece. As explained hereinbefore, method 1 according to the invention is not limited to the fabrication of a dial but applies to any type of plastic part decorated with relief. However, a timepiece dial is a good example of the application of method 1 according to the invention.

As seen in FIGS. 1 and 2, a dial 11 is typically a body 12 with several levels. In the example illustrated in FIG. 2, it can be seen that the body 12 includes, in particular, a circular recess 19 able to form a secondary display of the timepiece. It is also noted that the top face of body 12 includes an hour circle in the form of regularly spaced hour symbols 13. Likewise, the secondary display includes a second series of hour symbols 15 around said circular shape. Finally, the top surface includes a decoration 17 for concealing the shoulder between said top surface and recess 19.

As explained hereinbefore, to make this dial 11, these hour symbols 13, 15 and decoration 17 have to be added by successive bonding, then possibly masking and/or buffing steps when the relief is very pronounced. Advantageously according to the invention, fabrication method 1 provides a new type of fabrication which is particularly suited to plastic parts 21, which have very pronounced relief, i.e. higher than 40 μm.

Figure 8:
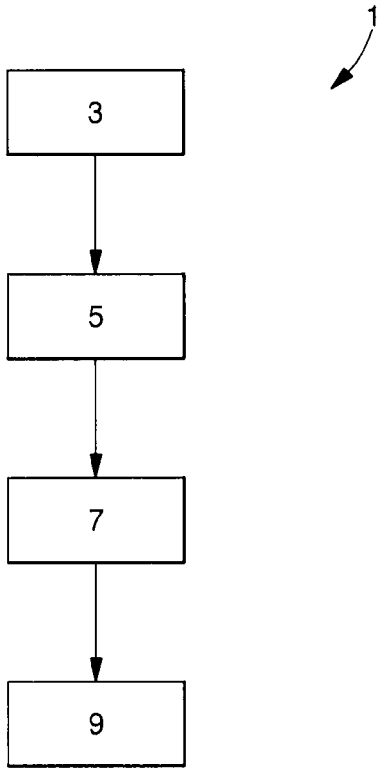
FIG. 8 is a flow diagram of the fabrication method according to the invention.

As illustrated in FIG. 8, fabrication method 1 includes a first step 3 for fabricating the main body 22 of the future plastic part 21 (a dial 21 in the example hereinbelow). Preferably, step 3 is achieved by injecting said plastic material into a mould (not shown). Indeed, this type of fabrication makes it possible to produce precise blanks of the relief portions of dial 21.

Figure 3:
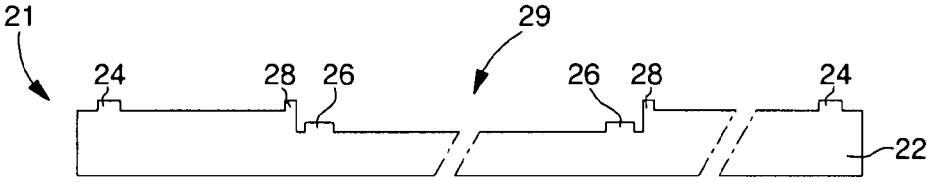
FIGS. 3 to 7 are diagrams of successive steps of two embodiments of the fabrication method according to the invention.

The example illustrated in FIG. 3 clearly shows the raised locations 24, 26 and 28, intended to form respectively the future hour symbols 23, 25 and decoration 27. The hollow portion 29 intended to form the secondary display can also be seen. It is thus clear that in a single step 3, the positioning of the various portions of dial 21 is very precisely achieved. According to the invention, the plastic material for making body 22 may be, for example, thermoplastic resins such as Styrenics, like Acrylonitrile Butadiene Styrene (ABS), acrylic resins like Poly(methyl methacrylate) (PMMA) and mixtures like PMMA/ABS, polyesters like Polyethylene Terephtalate (PET), Polybutylene Terephtalate (PBT), polyamides, Polycarbonates (PC), ABS/PC mixtures, an Ethylene vinyl acetate copolymer (EVA), polyimides or fluourinated resins such as Polytetrafluoroethylene (PTFE).

In a second step 5 of method 1, the surface of body 22 is structured so as to locally alter the surface state thereof. According to the invention, step 5 has two embodiments according to the adherence characteristics of the plastic material used. According to the invention, the decorative layer will be applied directly to the plastic body 22.

Figure 4:
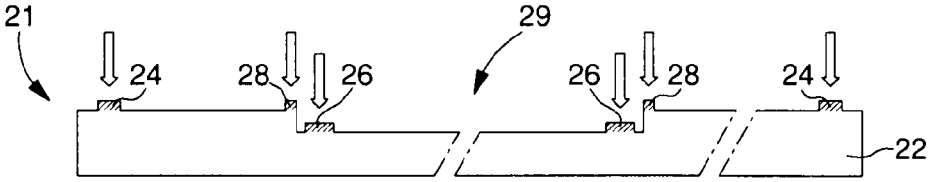

Thus, in a first embodiment in which the plastic material has a very low level of adherence relative to the decorative layer to be deposited, step 5, as illustrated in FIG. 4, is intended to locally increase the adherence of the surface of body 22 on the portions to be decorated, i.e. the raised portions 24, 26 and 28.

In the first embodiment, the very low adherence materials, called "not wetables" are, for example, but not exclusively, polyolefins (PE~70%, PP~60%, etc.), saturated polyesters (PET, PBT, etc.), polyamides (PA, etc.), fluoropolymers (PTFE>50%, etc.) or polyoxymethylenes (POM~80%, etc.).

Figure 9:
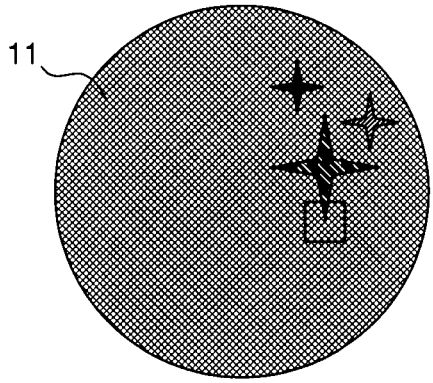
FIG. 9 is a schematic top view of a dial according to the invention.
Figure 10:
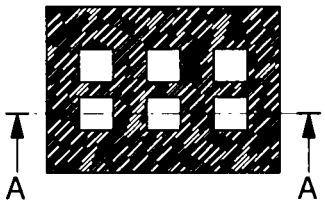
FIG. 10 is an enlarged diagram of one part of FIG. 9 according to a first embodiment.
Figure 11:
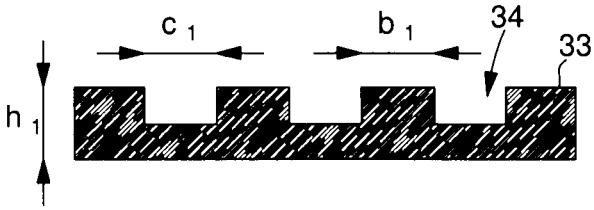
FIG. 11 is a cross-section A-A of FIG. 10.

In this first embodiment seen in FIGS. 9 to 11, the structuring for increased adherence includes bosses 33 formed by making hollows 34 in the thickness of the part to be decorated 11, which is not limited to a dial. By way of example, the height $h_1$ of hollows 34 is low, i.e. comprised between 2 and 10 μm and preferably around 5 μm, the width $c_1$ of hollows 34 is comprised between 5 and 20 μm and preferably around 10 μm, and the width $b_1$ of bosses 33 is comprised between 5 and 20 μm and preferably around 10 μm.

Preferably, the widths $c_1$, $b_1$ of hollows 34 and bosses 33 respectively are substantially equal. This local structuring thus advantageously increases the selective adherence of the surface which will be coated in step 7.

Figure 5:
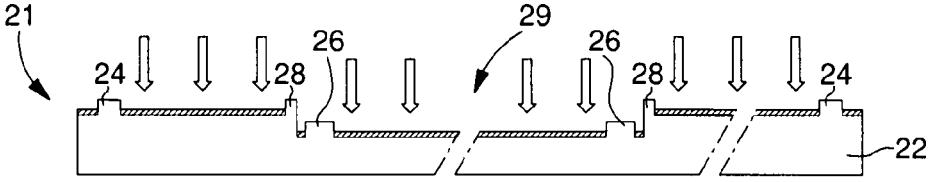

Conversely, in a second embodiment in which the plastic material has good adherence relative to the decorative layer to be deposited, step 5, as illustrated in FIG. 5, is intended to locally decrease the adherence of the surface of body 22 on the portions which are not to be decorated, i.e. all of the portions except for raised portions 24, 24 and 28.

In the second embodiment, materials that adhere well, called "wetable" materials are, for example, but not exclusively, poly carbonates (PC, etc.), Styrenics (ABS, PS, etc.), polyacrylics (PMMA, MABS, etc.), aromatic polysulphones (PSU, etc.), aromatic polyamides (25% semi-crystalline PPA, amorphous PPA, etc.) or poly(aryl ether ketone)s (semi crystalline PEEK etc.).

Figure 12:
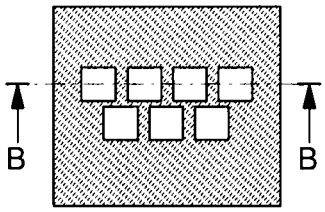
FIG. 12 is an enlarged diagram of one part of FIG. 9 according to a second embodiment.
Figure 13:
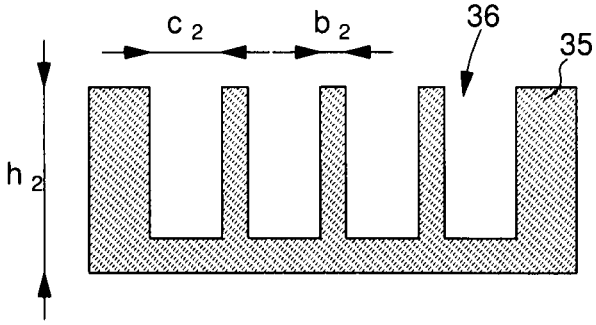
FIG. 13 is a cross-section B-B of FIG. 12.

In this second embodiment seen in FIGS. 9, 12 and 13, the adherence-reducing structuring includes bosses 35 formed by making hollows 36 in the thickness of the part to be decorated 11, which is not limited to a dial. By way of example, the height $h_2$ of hollows 36 is high, i.e. comprised between 50 and 200 μm and preferably around 100 μm, the width $c_2$ of hollows 36 is comprised between 5 and 20 μm and preferably around 10 μm, and the width $b_2$ of bosses 35 is small, i.e. comprised between 0.1 and 3 μm and preferably around 1 μm. This local structuring advantageously selectively decreases the adherence of the surface which will be coated in step 7.

Step 5 for selectively structuring the surface state of body 22 may be envisaged in a destructive or non-destructive manner. Indeed, according to a non-destructive alternative, the surface state could be "fabricated" at the same time as the body 22 itself, by "negatively" adapting the inner surface of the mould used in step 3. It is then clear that steps 3 and 5 would be performed at the same time.

However, step 5 for selectively structuring the surface state of body 22 may also be performed in a destructive manner in another alternative, i.e. by removing material. Preferably, in this other alternative, the structuring in step 5 is performed by laser type radiation which offers a very high level of precision for altering the surface state. Thus, body 22 may be removed from the mould and then subjected to said radiation, or, in a variant, the mould may comprise portions that are transparent to said radiation which allows said body to be structured "in situ", i.e. without prior removal from the mould.

Figure 6:
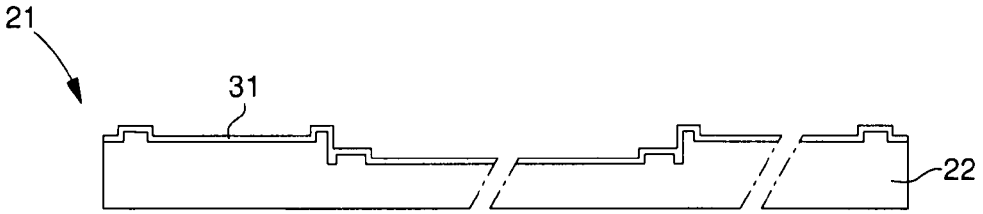
Figure 7:
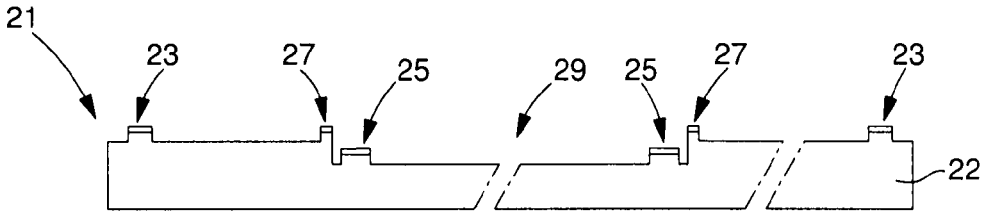

After the implementation of one of these two embodiments of step 5, the method 1 continues with a step 7 for depositing a decorative layer 31 over the entire body 22, as illustrated in FIG. 6. Preferably, step 7 is performed by physical vapour deposition (PVD). However, other types of deposition may be envisaged, such as galvanoplasty, chemical vapour deposition (CVD), atomic layer deposition (ALD) or even UV printing or lacquering.

Advantageously according to the invention, the last step 9 consists solely in removing the portions of the deposited layer 31 which have not adhered to body 22 of part 21. Indeed, owing to the structuring in one of the embodiments of step 5, the decorative layer 31 only remains, i.e. adheres, on hour symbols 23, 25 and decoration 27, as a result of step 9. Step 9 may, for example, be achieved by polishing, compressed air jet or by wet cleaning.

Preferably, the decorative layer 31 includes at least one metallic material, which allows dial 21 to offer a bright finish on the raised portions 23, 25 and 27 thereof. However, other types of materials can be envisaged, such as, for example, metal oxides and/or metal nitrides.

Finally, according to a variant, if decorative layer 31 is electrically conductive, decorations 23, 25, 27 may be electroplated after step 9, in order to thicken each portion including said decorative layer.

Upon reading the invention hereinbefore, it is thus clear that method 1 uses less material to form decorative layer 31 than the usual methods shown in FIGS. 1 and 2. Further, the problem of positioning portions 23, 25 and 27 is confined to the quality of performance of step 3.

Of course, this invention is not limited to the illustrated example but is capable of various variants and alterations that will appear to those skilled in the art. In particular, the body 22 may be made from a material different from a plastic material, such as, for example, a composite or ceramic material. Step 3 may also be achieved via a different method from the injection moulding presented hereinbefore, such as for example, calendering, thermoforming, compression moulding, stamping and/or drawing on a press.

Upon reading the invention hereinbefore, it is also clear that the flat surfaces of dial 21, in particular such as secondary display 29, may also be selectively coated with a decorative layer 31 to give an additional attractive effect. Suitable structuring need only be provided in step 5 for said coated portions of the flat surfaces of dial 21 to remain after step 9.

Finally, the shapes of hollows 34, 36 and/or bosses 33, 35 are not limited to the examples of FIGS. 10 and 12 but may, for example, be round, elliptical, rectangular or more generally polygonal.

The invention claimed is:

1. A method for fabricating a part with relief, wherein portions in said relief are at least partially coated with a decorative layer comprising steps of:

a) forming a body of the part;

b) selectively altering a surface state of portions of the body of the part in order to locally decrease adherence of the portions of the body to said decorative layer;

c) directly depositing said decorative layer over an entirety of the body, wherein said decorative layer deposited on the body does not adhere to the portions of the body altered in step b);

d) removing portions of said decorative layer which have not adhered to the body of the part, wherein locally decreasing adherence in step b) is obtained by forming bosses alternating with hollows, a height and a width of the hollows being between 50 and 200 micrometers and 5 and 20 micrometers, respectively, and a width of the bosses being between 0.1 and 3 micrometers.

2. The method according to claim 1, wherein the part with relief is a timepiece dial.

3. A method for fabricating a timepiece dial part including a partially coated relief, wherein portions in said relief are at least partially coated with a decorative layer comprising steps of:

a) forming a body of the timepiece dial part;

b) selectively altering a surface state of portions of the body of the part in order to change a level of adherence of the portions of the body to said decorative layer;

c) directly depositing said decorative layer over an entirety of the body;

d) removing portions of said decorative layer deposited on the body which have not adhered to the body of the part, wherein step c) of directly depositing said decorative layer includes directly depositing said decorative layer on the portions of the body having a changed level of adherence such that said decorative layer does not adhere to the portions of the body with the changed level of adherence.

4. A method for fabricating a timepiece dial part including a partially coated relief, wherein portions in said relief are at least partially coated with a decorative layer comprising steps of:

a) forming a body of the timepiece dial part;

b) selectively altering a surface state of portions of the body of the part in order to change a level of adherence of the portions of the body to said decorative layer;

c) directly depositing said decorative layer over an entirety of the body;

d) removing portions of said decorative layer deposited on the body which have not adhered to the body of the part, wherein step b) is for locally decreasing the level of adherence of the surface state of the portions of the body so that, in step c), said decorative layer does not adhere to the portions of the body altered in step b), and wherein step d) removes said decorative layer from the portions of the body where said decorative layer does not adhere while maintaining said decorative layer on other portions of the body where said decorative layer has adhered.

5. A method for fabricating a timepiece dial part including a partially coated relief, wherein portions in said relief are at least partially coated with a decorative layer comprising steps of:

a) forming a body of the timepiece dial part;

b) selectively altering a surface state of portions of the body of the part in order to change a level of adherence of the portions of the body to said decorative layer;

c) directly depositing said decorative layer over an entirety of the body;

d) removing portions of said decorative layer deposited on the body which have not adhered to the body of the part, wherein step b) is for locally increasing the level of adherence of the surface state of the portions of the body so that, in step c), said decorative adheres to the portions of the body altered in step b), and wherein step d) removes said decorative layer from the portions of the body where said decorative layer does not adhere while maintaining said decorative layer on the portions of the body where said decorative layer has adhered.

6. A method for fabricating a timepiece dial part including a partially coated relief, wherein portions in said relief are at least partially coated with a decorative layer comprising steps of:

a) forming a body of the timepiece dial part;

b) selectively altering a surface state of portions of the body of the part in order to change a level of adherence of the portions of the body to said decorative layer;

c) directly depositing said decorative layer over an entirety of the body;

d) removing portions of said decorative layer deposited on the body which have not adhered to the body of the part, wherein the body of the part is made using a plastic material and wherein the plastic material is one of polyolefins, saturated polyesters, polyamides, fluoropolymers, and polyoxymethylenes.

7. A method for fabricating a timepiece dial part including a partially coated relief, wherein portions in said relief are at least partially coated with a decorative layer comprising steps of:

a) forming a body of the timepiece dial part;

b) selectively altering a surface state of portions of the body of the part in order to change a level of adherence of the portions of the body to said decorative layer;

c) directly depositing said decorative layer over an entirety of the body;

d) removing portions of said decorative layer deposited on the body which have not adhered to the body of the part, wherein the body of the part is made using a plastic material and wherein the plastic material is one of poly carbonates, styrenics, polyacrylics, aromatic polysulphones, aromatic polyamides, and polyaryletherketone.

8. The method according to claim 3, wherein the body of the part is made using a plastic material and wherein the plastic material is one of polyolefins, saturated polyesters, polyamides, fluoropolymers, and polyoxymethylenes.

* * * * *